US008348536B2

(12) United States Patent
Yoon

(10) Patent No.: US 8,348,536 B2
(45) Date of Patent: Jan. 8, 2013

(54) ROTARY-TYPE RETRACTABLE WRITING IMPLEMENT WITH AN ANTI-DRYING DEVICE

(75) Inventor: Hyun-Son Yoon, Incheon (KR)

(73) Assignee: Morris Corporation, Icheon (KR)

( * ) Notice: Subject to any disclaimer, the term of this patent is extended or adjusted under 35 U.S.C. 154(b) by 0 days.

(21) Appl. No.: 13/258,832

(22) PCT Filed: Mar. 23, 2010

(86) PCT No.: PCT/KR2010/001777

§ 371 (c)(1),
(2), (4) Date: Sep. 22, 2011

(87) PCT Pub. No.: WO2010/110582

PCT Pub. Date: Sep. 30, 2010

(65) Prior Publication Data

US 2012/0020719 A1 Jan. 26, 2012

(30) Foreign Application Priority Data

Mar. 23, 2009 (KR) ..... 10-2009-0024453

(51) Int. Cl.

| | |
|---|---|
| ***B43K 5/16*** | (2006.01) |
| ***B43K 5/17*** | (2006.01) |
| ***B43K 24/06*** | (2006.01) |

(52) U.S. Cl. ..... 401/108; 401/99; 401/109; 401/112; 401/116

(58) Field of Classification Search ..... 401/99, 401/107–109, 112, 113, 116
See application file for complete search history.

(56) References Cited

U.S. PATENT DOCUMENTS

| | | | | |
|---|---|---|---|---|
| 6,964,534 | B2 * | 11/2005 | Brand et al. | 401/108 |
| 2008/0193194 | A1 * | 8/2008 | Yoon | 401/109 |
| 2008/0226380 | A1 * | 9/2008 | Saito | 401/116 |

FOREIGN PATENT DOCUMENTS

| | | | |
|---|---|---|---|
| KR | 10-0549117 | B1 | 2/2006 |
| KR | 10-0738904 | B1 | 7/2007 |
| KR | 10-0817202 | B1 | 3/2008 |
| KR | 20-0441336 | | 8/2008 |

OTHER PUBLICATIONS

International Search Report for PCT Application No. PCT/KR2010/001777. Korean Intellectual Property Office. Mar. 23, 2010.

* cited by examiner

*Primary Examiner* — David Walczak
*Assistant Examiner* — Bradley Oliver
(74) *Attorney, Agent, or Firm* — Hyunho Park

(57) ABSTRACT

A rotary-type retractable writing implement with an anti-drying device is provided. An upper shaft and a lower shaft are coupled together such that the two shafts are rotatable in opposite directions, and a cartridge accommodated in an intermediate connection member is movable, and an open/shut module for covering a nib opens/shuts by the movement of the cartridge so as to provide a nib-advancing path.

7 Claims, 10 Drawing Sheets

ROTARY-TYPE RETRACTABLE WRITING IMPLEMENT WITH AN ANTI-DRYING DEVICE

PRIORITY

The present application claims priority under 35 U.S.C. §371 to PCT Application PCT/KR2010/001777, filed on Mar. 23, 2010, which claims priority to Korean Patent Application No. 10-2009-0024453, filed on Mar. 23, 2009, the disclosures of which are hereby incorporated by reference in their entireties.

TECHNICAL FIELD

The present invention relates, in general, to a rotary-type retractable writing implement with an anti-drying device and, more particularly, to a rotary-type retractable writing implement with an anti-drying device, in which a nib where writing ink is absorbed is provided, and as upper and lower-shaft housings thereof rotate opposite to each other, a nib cartridge is moved concurrently with the opening/closing of a shutter module in a sequential manner.

BACKGROUND ART

Generally, a nib-type writing implement, such as Maka pen®, has a cap for preventing ink absorbed in a nib from drying.

However, when using the writing implement, the cap should be opened and closed before and after writing, so that opening and closing the cap is troublesome. In addition, since the opening and closing work should be done with both the user's hands, if the user is using one of his hands, opening and closing cannot be done, or otherwise the user has no choice but to stop doing his work in order to open and close the cap.

In order to solve the above problem, a conventional technique was proposed in which a knock is attached to a distal end of a writing implement such that it is operated to automatically open/close a nib passage (hereinafter, the symbol "/" means "and"). However, the conventional technique has a problem in that if it is carried while being loaded in a bag or the like, the knock is occasionally pushed by external force, causing the nib to protrude, which not only causes ink absorbed in the nib to leak and contaminate the surroundings, but also crushes the nib, disabling writing using the nib.

DISCLOSURE

Technical Problem

Accordingly, the present invention has been made keeping in mind the above problems occurring in the related art, and an object of the present invention is to provide a rotary-type retractable writing implement with an anti-drying device, in which as upper and lower portions thereof rotate opposite to each other, a nib cartridge moves up and down in the direction of a pen-lead, which causes a shutter module to be opened/closed so that a nib is retractably advanced through a nib hole.

Another object of the present invention is to provide a rotary-type retractable writing implement with an anti-drying device, in which a shutter module is provided which is configured such that as a nib cartridge advances towards a nib hole, the shutter module provides a passage through which a nib is retractably advanced, and as the nib cartridge is retracted, the shutter module seals the nib in order to prevent ink absorbed in the nib from drying.

Technical Solution

In an aspect, the present invention provides a rotary-type retractable writing implement with an anti-drying device including: a nib cartridge having a writing nib; an intermediate connection member having a slit along which the nib cartridge moves in the longitudinal direction in the intermediate connection member; a lower-shaft housing fixedly coupled with the intermediate connection member and having a nib hole through which the nib is retractably advanced; an upper-shaft housing having a thread along which the nib cartridge received in the intermediate connection member moves as the intermediate connection member and the lower-shaft housing are rotated together; and a ball shutter disposed in the lower-shaft housing and configured to open a passage for the nib when the nib is advanced in response to the longitudinal movement of the nib cartridge and to close the passage for the nib when the nib is retracted, such that the nib is received in the closed space, wherein as the intermediate connection member and the lower-shaft housing are rotated together, the nib cartridge moves downwards to cause the nib to protrude to the outside from the lower-shaft housing.

In an embodiment, the ball shutter includes: an o-ring part to be brought into close contact with the surface of the nib hole of the lower-shaft housing; a ball type door having a spherical surface designed to block the nib such that the nib is sealed from the outside; a holder having the form of a cylinder forming a through-passage for the nib; a first hinge connecting the o-ring part and the ball type door; and a second hinge integrally connecting the ball type door and the holder, wherein as the holder moves away from the o-ring part being in a fixed state, the first and second hinges are bent to cause the ball type door to rotate, thereby providing the through-passage for the nib.

In an embodiment, the nib cartridge includes: an engaging step formed at a connection between a nib extension and an ink tank such that the nib passing through the inside of the ball shutter does not advance any further into the ball shutter; a spring holding protrusion provided in the middle of an outer surface of the ink tank such that a first spring generates elastic force between the nib cartridge and one side of the ball shutter; a tooth provided at a distal end of the ink tank such that the tooth linearly moves along the slit of the intermediate connection member, while concurrently moving along the thread of the upper-shaft housing; and a guide protrusion provided on the engaging step such that the guide protrusion linearly moves along the ball shutter within a slit range.

In an embodiment, the holder of the ball shutter has a slit for the nib cartridge in the direction of the nib cartridge such that the guide protrusion of the nib cartridge moves within the range of the slit for the nib cartridge.

In an embodiment, the intermediate connection member includes: a coupling rim for the lower-shaft housing having the form of a protruding ring in the end of one side of the intermediate connection member such that the coupling rim is engaged and fixedly coupled with an inner groove of the lower-shaft housing; a coupling groove having the form of a ring formed a certain distance away from the coupling rim such that the intermediate connection member and the upper-shaft housing are coupled such that they are rotated with respect to each other; and an anti-rotation protrusion provided a certain distance away from the coupling groove, wherein a tooth of the nib cartridge received in the intermediate connection member is exposed to the outside of the slit, so that as the intermediate connection member and the lower-shaft housing are rotated, the tooth moves along the slit.

In an embodiment, the intermediate connection member further includes: a coupling groove for the lower-shaft housing on the coupling rim such that the intermediate connection member and the lower-shaft housing are securely fixed, the coupling groove being perpendicular to the coupling rim, wherein the coupling groove is configured such that when coupled with the lower-shaft housing, the coupling groove is engaged with a step of the lower-shaft housing provided at the position corresponding to the position of the coupling groove.

In an embodiment, the lower-shaft housing includes: a groove provided in one side thereof at the position corresponding to the position of the coupling rim of the intermediate connection member and engaged with the coupling rim to create a secure coupling between the lower-shaft housing and the intermediate connection member; a fixing step provided on an inner wall of the other side thereof such that an upper ring of the ball shutter is fixedly attached thereto; and a spring holding protrusion provided a certain distance away from the fixing step and against which a second spring is held by a step on an outer surface of the ball shutter so that opposite ends of the second spring are respectively engaged with the spring holding protrusion and the step of the ball shutter.

In an embodiment, the upper-shaft housing includes: a coupling protrusion for the intermediate connection member provided on one side of an inner surface thereof such that the upper-shaft housing is rotatably coupled with the coupling groove for the upper-shaft housing, provided in the intermediate connection member inserted into the upper-shaft housing; a stopper provided a certain distance away from the coupling protrusion and having a thickness over which an anti-rotation protrusion of the intermediate connection member is able to climb; a step provided on one side of the stopper and having a thickness over which the anti-rotation protrusion of the intermediate connection member is not able to climb; and a thread provided a certain distance away from the stopper or the step such that the thread forms a guide passage along which as the nib cartridge rotates together with the intermediate connection member, a tooth of the nib cartridge moves.

Advantageous Effects

As described above, according to the rotary-type retractable writing implement with an anti-drying device of the present invention, the nib can be advanced only when the upper and lower portions of the writing implement rotate together, so that even though external force is exerted to any part of the main body of the writing implement, the nib is not exposed to the outside, providing the effect of allowing the writing implement to be safely stored in a bag or the like.

Further, according to the rotary-type retractable writing implement with an anti-drying device of the present invention, the shutter module storing therein the nib is rotated to actuate the opening/closing the movement of the nib cartridge, providing the effect of preventing ink absorbed in the nib from drying.

BRIEF DESCRIPTION OF REFERENCE NUMERALS

100: Upper-Shaft Housing 200: Lower-Shaft Housing
500: Nib Cartridge 600: Ball Shutter
700: Intermediate Connection Member

MODE FOR INVENTION

Hereinbelow, preferred embodiments of the present invention will be described in detail with reference to the accompanying drawings.

Figure 1:
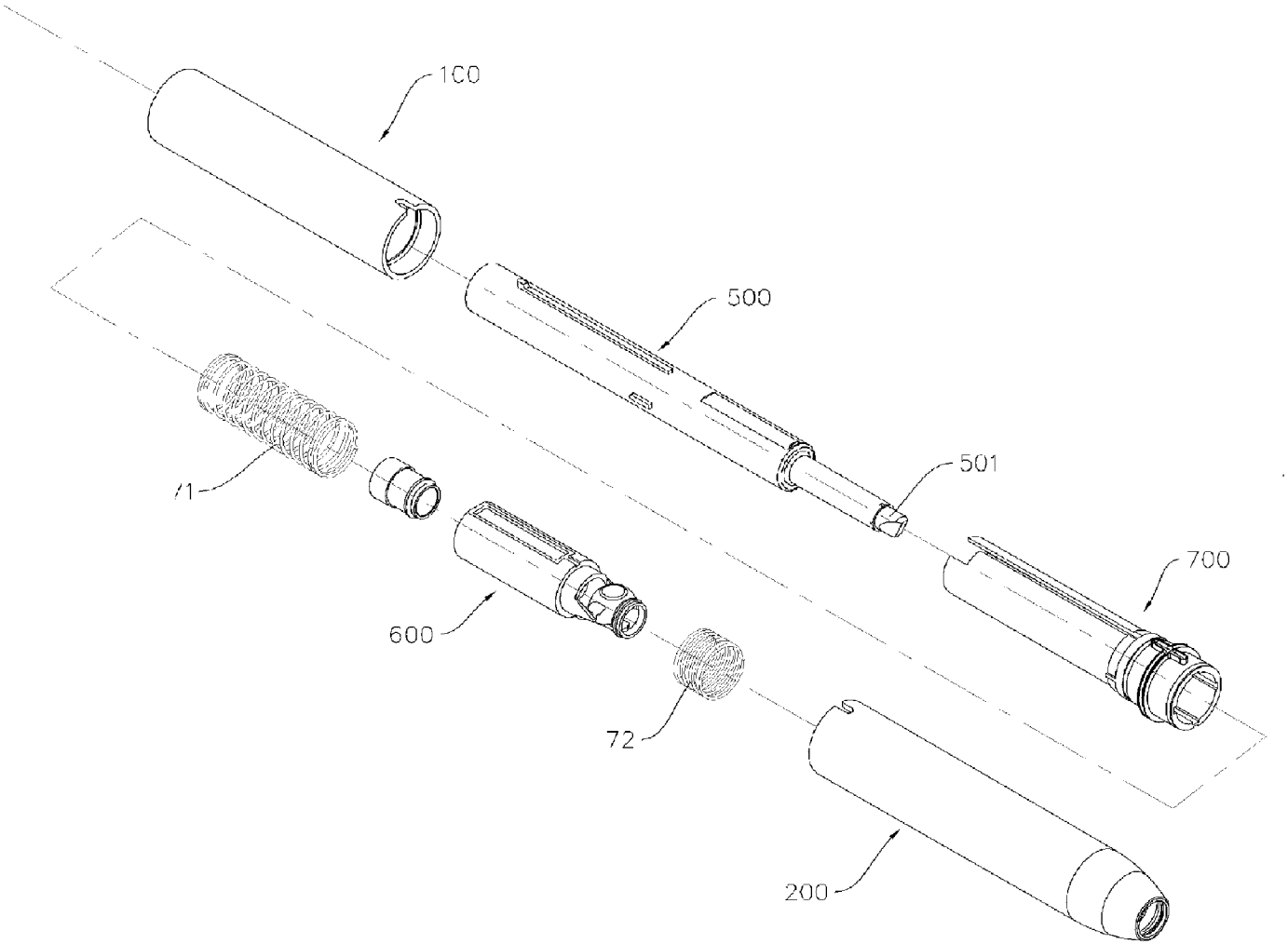
FIG. 1 is an exploded perspective view of a rotary-type retractable writing implement with an anti-drying device according to an embodiment of the present invention.

FIG. 1 is an exploded perspective view of a rotary-type retractable writing implement with an anti-drying device according to an embodiment of the present invention.

As shown in FIG. 1, the rotary-type retractable writing implement with an anti-drying device includes a nib cartridge 500 in which a nib 501 is mounted, an intermediate connection member 700 having a slit along which the nib cartridge moves in the longitudinal direction in the intermediate connection member, a lower-shaft housing 200 fixedly coupled with the intermediate connection member, an upper-shaft housing 100 having a thread along which a protrusion of the nib cartridge, received in the intermediate connection member, moves as the intermediate connection member and the lower-shaft housing are rotated together, and a ball shutter 600 configured to open and close a nib hole in response to the longitudinal movement of the nib cartridge.

In addition, first and second springs 71 and 72 are mounted in the side of the nib cartridge and the upper portion of the ball shutter in the upper-shaft housing.

Here, it is preferred that the elastic force of the first spring 71 be higher than that of the second spring so that when being applied with external force, the second spring 72 is first compressed before the first spring 71 is compressed.

Further, it is also preferred that for secure coupling and easy operation, the respective related components of the writing implement have a pair of interworking features such as protrusions and corresponding steps, grooves, or threads in both sides of inner or outer surfaces thereof.

In describing the embodiments of the present invention hereafter, it is noted that the direction in which the nib protrudes towards a nib hole is denoted as the downward direction, the direction in which the nib is retracted is denoted as the upward direction, and in connection with the operation of the nib, the direction in which the nib protrudes towards the nib hole is denoted as the forward or advanced direction, and the direction in which the nib is retracted is denoted as the reverse or retracted direction.

Figure 2:
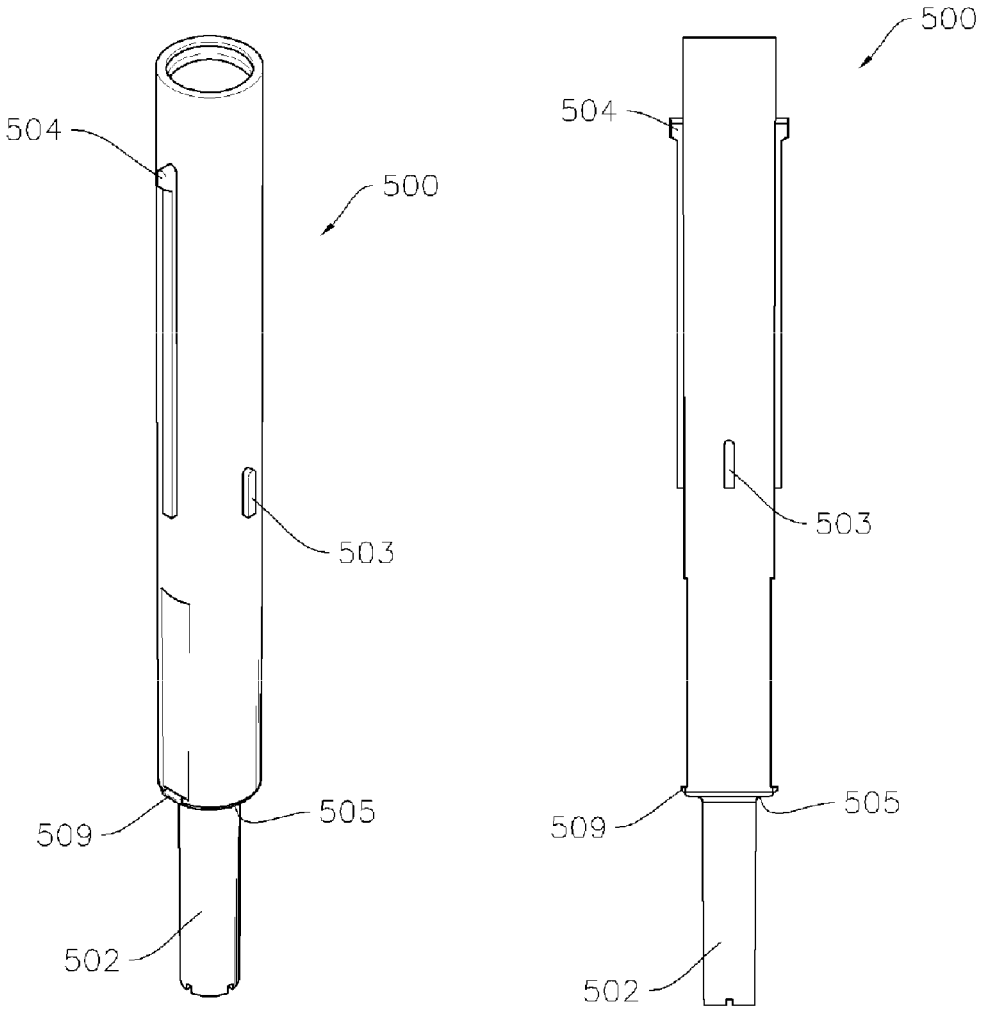
FIG. 2 shows a nib cartridge according to an embodiment of the present invention in a perspective view and a side view.

FIG. 2 shows the nib cartridge 500 according to an embodiment of the present invention in a perspective view and a side view.

As shown in FIG. 2, the nib cartridge has a nib 501 in one side, and the nib 501 is fixed inside a nib extension 502 such that it is supplied with ink from a hole at one side of the nib extension.

The nib extension 502 has the form of a hollow cylinder, a diameter of which is relatively smaller than an ink tank disposed adjacent thereto.

In addition, the nib 501 can be fixed in the nib extension in such a way as to protrude out from a distal end of the nib extension such that it is supplied with ink or other content contained in the ink tank according to a common supply manner (such as using a capillary phenomenon, pressure difference, absorption, etc.) that corresponds to the kinds of related writing implements.

The nib 501 may include tips for oily or aqueous ink, dispensing a remover solution, highlighters, Maka pen®, or the like according to the kind of writing implements. Here, many ink supply methods are of course adapted in conformity with the respective tips.

The nib 501 of the nib cartridge 500 is advanced and retracted from the nib hole 205 of the lower-shaft housing 200 according to an advancing/retracting mechanism to be described later.

The nib cartridge 500 is provided, at a connection between the nib extension 502 and the ink tank, with an engaging step 505 by which when inserted into the ball shutter 600, the nib cartridge 500 and the nib 501 fixed thereto cannot be further advanced inside the ball shutter 600.

The nib cartridge 500 is also provided, in the middle of an outer surface of the ink tank, with a spring holding protrusion 503 against which the first spring 71 that will be described later is held by one side of the ball shutter 600, generating elastic force.

The nib cartridge 500 also has a tooth 504 in the distal end of the ink tank. The tooth 504 is designed to move along an internal thread that is formed in an inner surface of the upper-shaft housing 100, which will be described later. The tooth is also designed to move along the slit of the intermediate connection member 700 to be described later.

In addition, the nib cartridge 500 has a guide protrusion 509 on the engaging step 505, the guide protrusion being linearly guided along a slit of the ball shutter 600, which will be described later.

Figure 3:
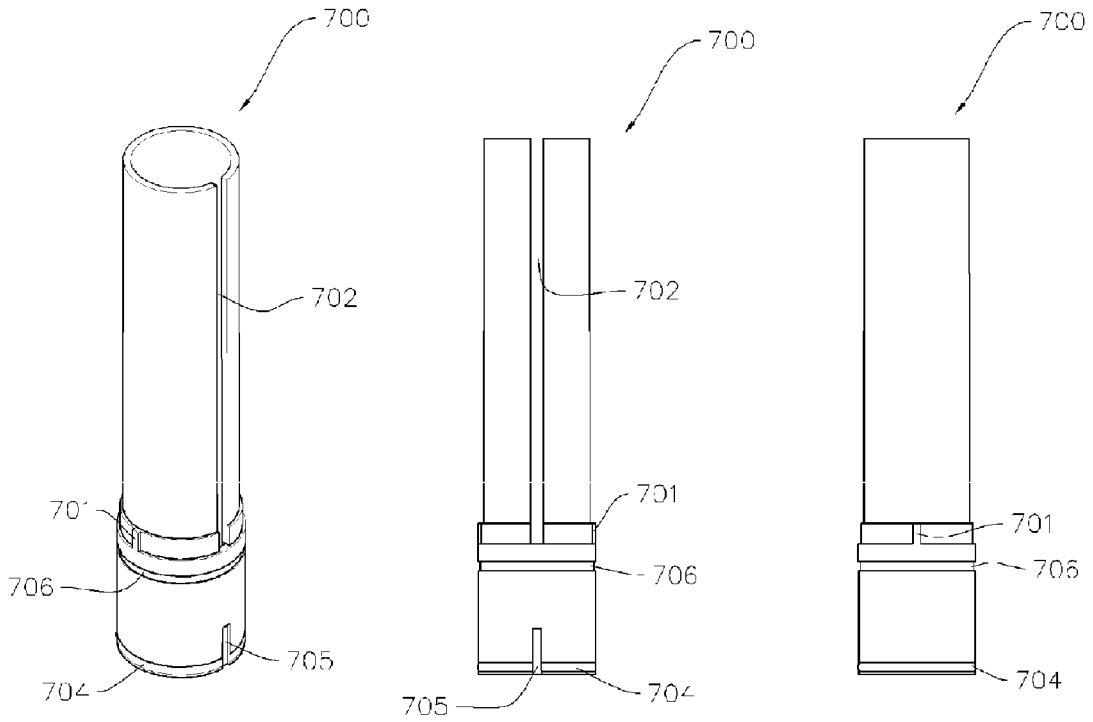
FIG. 3 shows an intermediate connection member according to an embodiment of the present invention in a perspective view and a side view.

FIG. 3 shows the intermediate connection member 700 according to an embodiment of the present invention in a perspective view and a side view, wherein the intermediated connector housing is provided with the slit along which the nib cartridge 500 is moved in the longitudinal direction in the intermediate connection member.

As shown in FIG. 3, the intermediate connection member 700 has the form of a hollow cylinder through which the nib cartridge 500, received therein, reciprocates in the longitudinal direction.

The intermediate connection member 700 is provided, in the distal end, with a coupling rim 704 shaped like a protruding ring, which is fixedly coupled with the lower-shaft housing 200 to be described later through engagement with an inner groove of the lower-shaft housing, which will also be described later.

Preferably, for secure coupling between the intermediate connection member 700 and the lower-shaft housing 200, the coupling rim 704 is provided with a coupling groove 705 which is perpendicular to the coupling rim 704 and in which a step (which is formed on the inner surface of the lower-shaft housing 200 at the position corresponding to the coupling groove when coupled with the lower-shaft housing 200, thereby preventing relative rotation between the intermediate connection member 700 and the lower-shaft housing 200.

The intermediate connection member 700 is also provided with a ring type coupling groove 706 for the upper-shaft housing a certain distance away from the coupling rim 704 for the lower-shaft housing such that the intermediate connection member is rotatably coupled with the upper-shaft housing 100.

In addition, an anti-rotation protrusion 701 is formed a certain distance away from the coupling groove 706 for the upper-shaft housing. Thus, upon relative rotation between the intermediate connection member and the upper-shaft housing, the anti-rotation protrusion is engaged between a stopper and an engaging step of the upper-shaft housing, thereby preventing further rotation of the upper-shaft housing relative to the intermediate connection member.

In the meantime, the intermediate connection member 700 has the slit 702 that extends from the anti-rotation protrusion 701 to the other end of the intermediate connection member.

Here, the slit 702 is designed such that the tooth 505 of the nib cartridge 700, which is received in the intermediate connection member 700, is exposed to the outside of the slit 72, and as the intermediate connection member 700 is rotated together with the lower-shaft housing 200, the tooth 504 moves along the slit 702.

Figure 4:
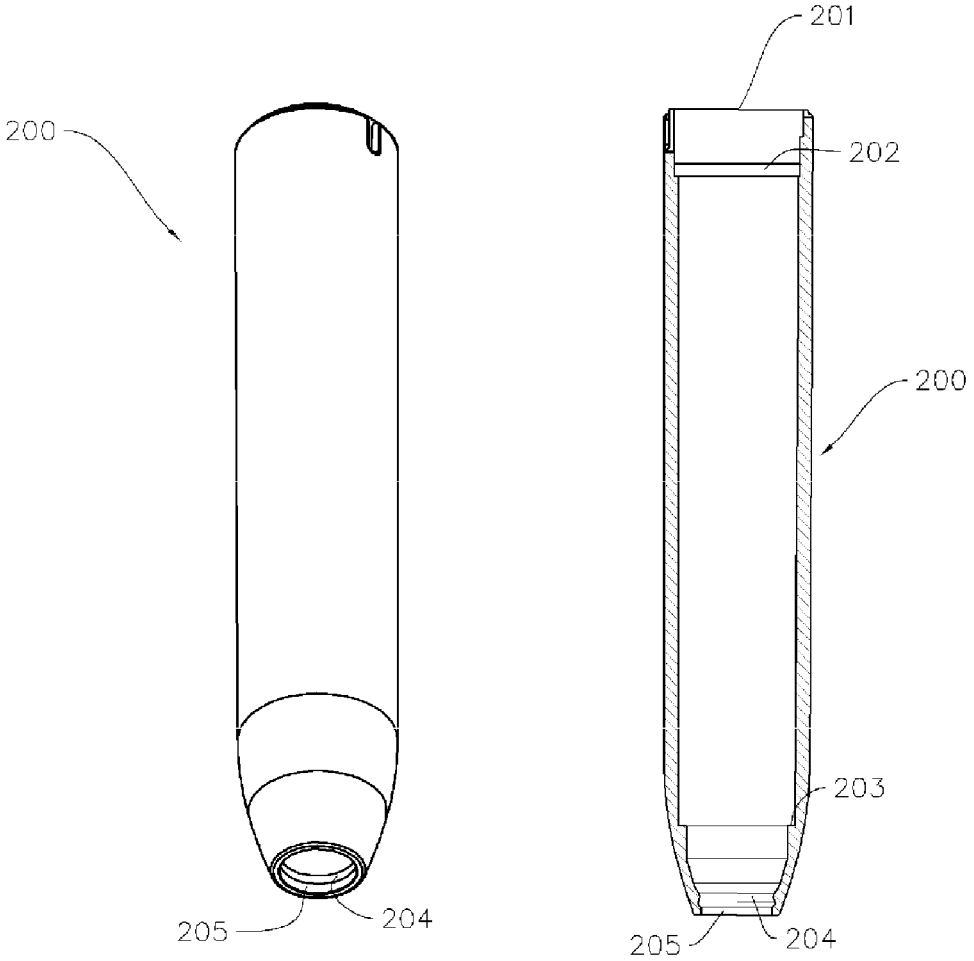
FIG. 4 shows a lower-shaft housing according to an embodiment of the present invention in a perspective view and a cross-sectional view.

FIG. 4 shows the lower-shaft housing 200 according to an embodiment of the present invention in a perspective view and a cross-sectional view, wherein the lower-shaft housing receives the nib cartridge 500 such that the nib is retractably advanced out of the lower-shaft housing.

As shown in FIG. 4, the lower-shaft housing has, in one side, a groove 202 and a step (not designated with a reference numeral) which are located at the position corresponding to the coupling rim 704 and coupling groove 705 of the intermediate connection member 700 for the lower-shaft housing and are engaged with them to create a secure coupling with the intermediate connection member 700.

In addition, the lower-shaft housing 200 has, in the other side, the circular nib hole 205 through which the nib 501 retractably protrudes. In the nib hole, a fixing step 204 is provided to which an upper ring of the ball shutter 600 is fixedly attached.

Further, the lower-shaft housing 200 has a spring holding protrusion 203 for the second spring, which is provided a certain distance away from the fixing step 204 and against which the second spring 72 is held by an outer step of the ball shutter which will be described later.

Figure 5:
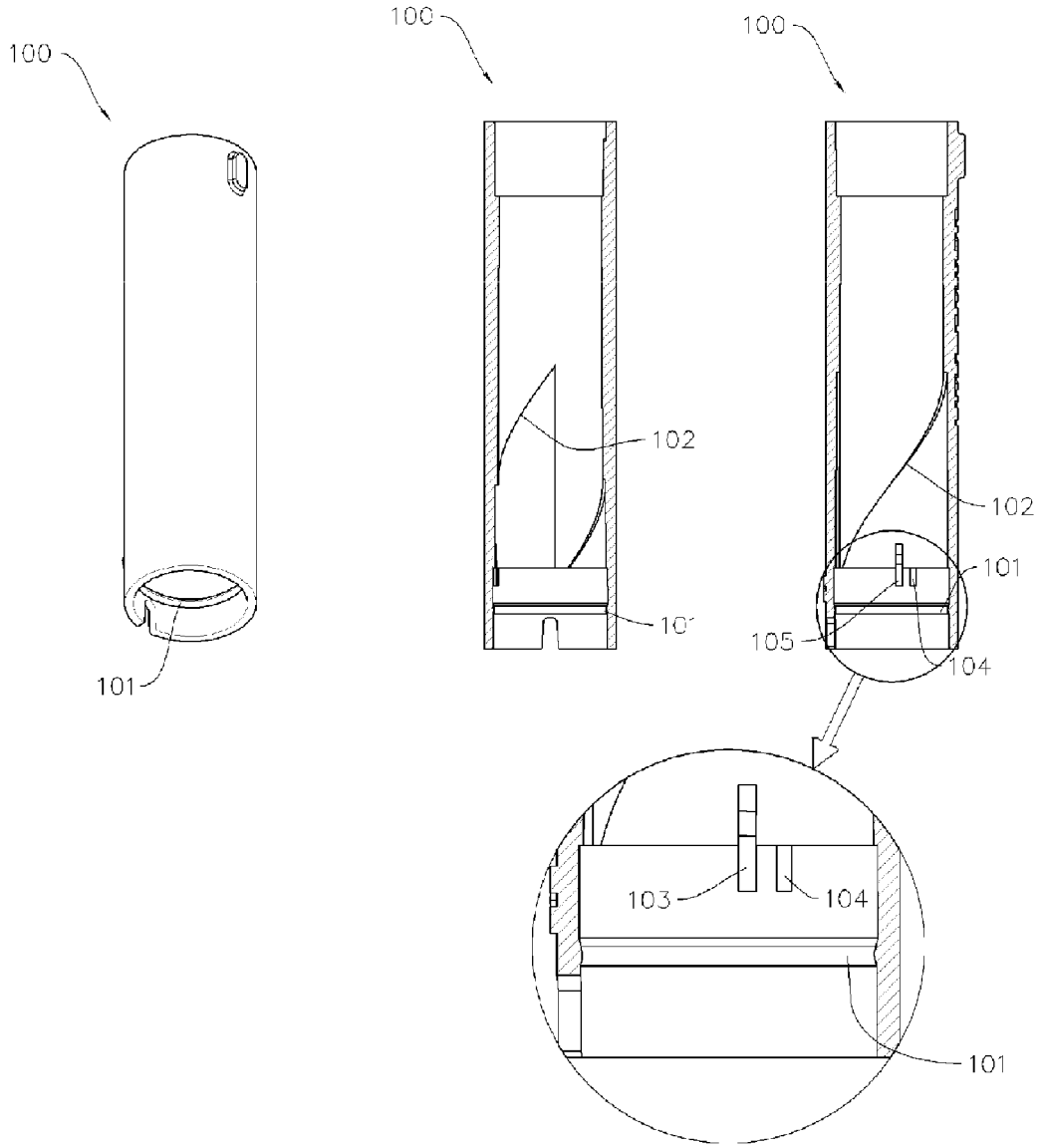
FIG. 5 shows an upper-shaft housing according to an embodiment of the present invention in a perspective view and a cross-sectional view.

FIG. 5 shows the upper-shaft housing 100 according to an embodiment of the present invention in a perspective view and a cross-sectional view.

As shown in FIG. 5, the upper-shaft housing 100 has the form of a cylinder which is provided, in one side of the inner surface, with a coupling protrusion 101 for the intermediate connection member, which is rotatably coupled into the coupling groove 706 of the intermediate connection member 700 when the intermediate connection member is inserted into the upper-shaft housing.

In addition, the upper-shaft housing 100 is provided, at a certain distance away from the coupling protrusion 101 for the intermediate connection member, with a stopper 103 and an engaging step 104, which have the form of a protrusion, in order to engage with the anti-rotation protrusion 701 of the intermediate connection member 700.

That is, as the intermediate connection member 700 is rotated relative to the upper-shaft housing 100, the anti-rotation protrusion 701 comes into contact with the stopper 103 and then climbs over the stopper 103, so that the intermediate connection member 700 cannot be rotated in the reverse direction because the anti-rotation protrusion 701 is engaged again with the stopper 103 in the reverse rotation direction.

Further, after having climbed over the stopper 103, the anti-rotation protrusion 701 is in turn engaged with the engaging step 104, so that the intermediate connection member 700 cannot be further rotated forwards, nor be rotated in the reverse direction by the stopper 103, thereby obtaining secure fixation of the intermediate connection member.

For the above-mentioned operation, the engaging step 104 preferably protrudes farther than does the stopper 103.

In addition, a thread 102 is provided, in the upper-shaft housing, a certain distance away from the stopper 103 and the engaging step 104.

The thread 103 serves as a guide passage along which the tooth 504 of the nib cartridge 500 moves as the nib cartridge 500 rotates together with the intermediate connection member 700.

A moving range of the nib cartridge 500, which moves along the slit 702 of the intermediate connection member 700 within a range of rotation (about 180 degrees) of the intermediate connection member 700 and the lower-shaft housing 200 that they rotate together, is determined by an angle at which the thread 102 extends, i.e. a pitch of the thread. Thus, the thread 102 for the upper-shaft housing preferably has a certain angle of the thread in order to allow the nib 501 of the nib cartridge 500 to sufficiently protrude out of the nib hole.

Figure 6:
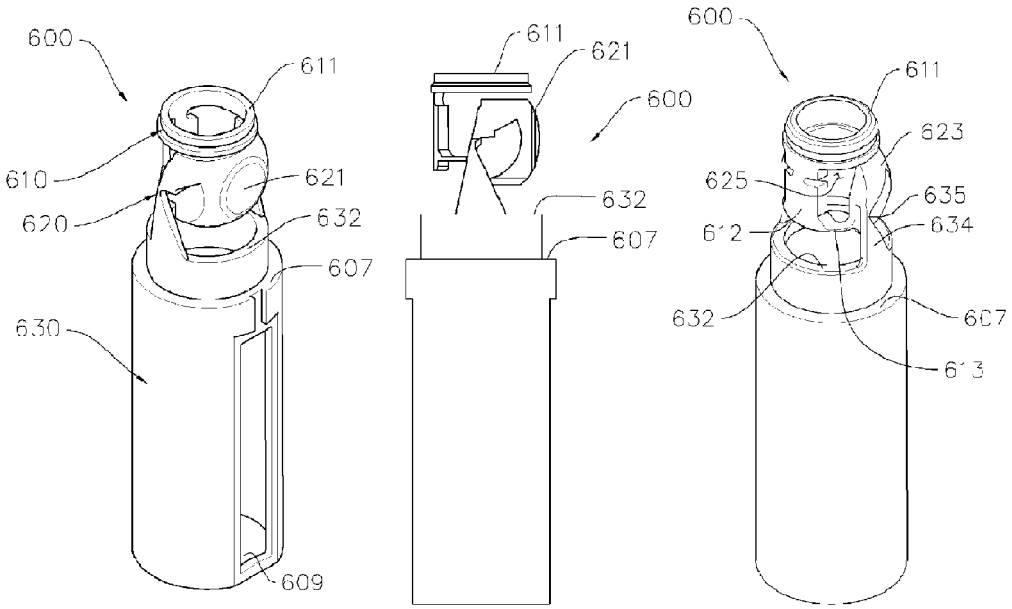
FIG. 6 shows a ball shutter according to an embodiment of the present invention in a perspective view and a side view.

FIG. 6 shows the ball shutter 600 according to an embodiment of the present invention in a perspective view and a side view.

As shown in FIG. 6, the ball shutter 600 is an element that has the same or similar construction and operation as or to those of a shutter module of a retractable writing implement, which was disclosed in Korean Unexamined Patent Publication No. 10-2008-0074269 and Korean Patent No. 10-0738904, which were granted to the applicant.

The ball shutter 600 is injection-molded with a rubber-like elastic material, so that it can be expected to have improved durability capable of resisting repetitive bending stress. In addition, as described below, the ball shutter is configured such that a ball type door thereof can be brought into close contact with the surface of an inlet of a holder thereof, further maximizing the effect of the anti-drying ink.

In addition, the ball shutter 600 integrally includes an o-ring part 610, the ball type door 620, and the holder 630.

The o-ring part 610 has an o-ring 611 that is a packing ring to be brought into close contact with the surface of the nib hole 205 of the lower-shaft housing 200, fixedly sealing the nib hole.

A vertical bar 612 of the o-ring 611 is a support formed like a bar that vertically extends from a portion of the o-ring 611.

The ball type door 620 serves as a driven joint in connection with the holder 630, thereby functioning as a door structure that opens and closes the nib hole 205. To this end, the ball type door 620 has a substantially hemi-spherical surface 621.

In addition, the ball type door 620 has an open through-passage 625 opposite the spherical surface 621. Thus, upon actuation of the writing implement, as the ball type door rotates, the through-passage provides a path through which the nib cartridge 500 reciprocates.

In addition, the ball type door 620 has spire-type connections 623 that extend from the spherical surface 621. The holder 630 is the part in which the nib cartridge 500 is held.

An upper end 632 of the holder 630 has a diameter smaller than that of the ball type door 630, but larger than the diameter of the nib cartridge 500 such that it comes into close contact with the spherical surface 621 of the ball type door 620.

In addition, a rubber packing may preferably be fitted around the inner surface of the upper end 632, increasing the adherence with the spherical surface 621.

In addition, the holder 630 has spire-type connections 634 that extend from both sides of the upper portion thereof and distal ends of which are coupled with the distal ends of the connections 623 of the ball type door 620.

A second hinge 635 is a point at which the connections 623 of the ball type door 620 and the connections 634 of the holder 630 intersect. The connections 623 of the ball type door 620 rotate about the connections 634 of the holder 630 by means of the second hinge 635.

That is, the connections 634 of the holder 630 are triangular surfaces with the same shape that are respectively defined from the left and right sides of the upper end 632, and the tips thereof converge into the form like the spire, forming the second hinge 635 that is connected with the connections 623 of the ball type door 620.

In addition, a first hinge 613 is a connection member that connects the tip of the vertical bar 612, which protrudes from a portion of the o-ring 611, and both ends of the lower end of the ball type door 620, serving as a hinge of the ball type door 620 about the o-ring part 610.

To this end, the first hinge 613 preferably has the form of a circular band, on which the tip of the vertical bar 612 and the lower end of the ball type door 620 are integrally formed.

In addition, the holder 630 has an engaging protrusion (not designated with reference numeral) and a step 607 below the upper end 632 of the holder.

The engaging protrusion is a step that is formed in the holder 630 and against which the nib cartridge 500 being inserted into the holder 630 is engaged so as to prevent the nib cartridge 500 from advancing further towards the nib hole 205.

The step 607 is formed outside the holder 630 and it is engaged against the second spring 72.

One end of the holder 630 and the spring holding protrusion 503 of the nib cartridge 500 are provided such that the first spring 71 is held therebetween so that opposite ends of the spring are respectively engaged with them.

In addition, the holder 630 has a slit 609 that extends in the longitudinal direction of the nib cartridge 500 such that the nib cartridge moves along the slit 609. Here, the guide protrusion 509 of the nib cartridge 500 is guided along the slit 609 within a range of length of the slit 609.

Generally summarizing the connection relation of the ball shutter 600, the o-ring 611 is connected with the vertical bar 612; the vertical bar 612 is connected with the ball type door 620 by means of the first hinge 613; the ball type door 620 is connected with the connections 634 of the holder 630 by means of second hinge 635; and the connections 634 are connected with the upper end 632 of the holder 630, thereby forming a single piece of the ball shutter 600.

Figure 7:
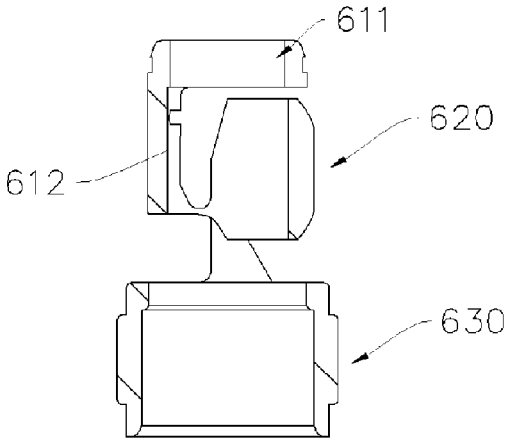
FIGS. 7 and 8 are cross-sectional views showing the operation of the ball shutter of FIG. 6.
Figure 8:
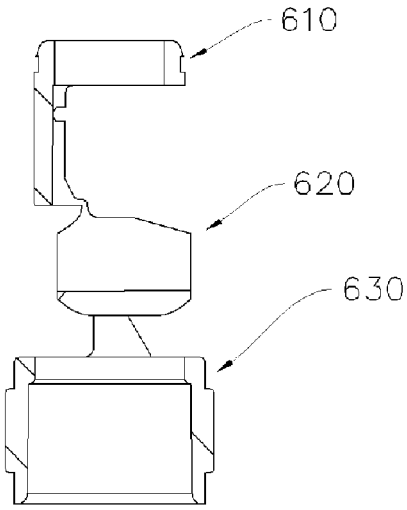

FIGS. 7 and 8 are cross-sectional views showing the operation of the ball shutter of FIG. 6.

Summarizing the operation of the ball shutter 600 with reference to FIGS. 7 and 8, when the holder 630 is pulled in the state of being fixed onto the inside of the nib hole 205 of the lower-shaft housing 200, the ball type door 620 is rotated about the connections 634, so that the second and first hinges 635 and 613 are bent.

That is, when the holder 630 is pulled in the state that the o-ring part 610 is being fixedly attached to the fixing step 204 of the lower-shaft housing 200, the ball type door is rotated at 90° to close the inlet of the holder 630. Conversely, when the holder 630 is moved to its original position, the ball type door 620 is reversely rotated at 90° to open the holder 630.

Figure 9:
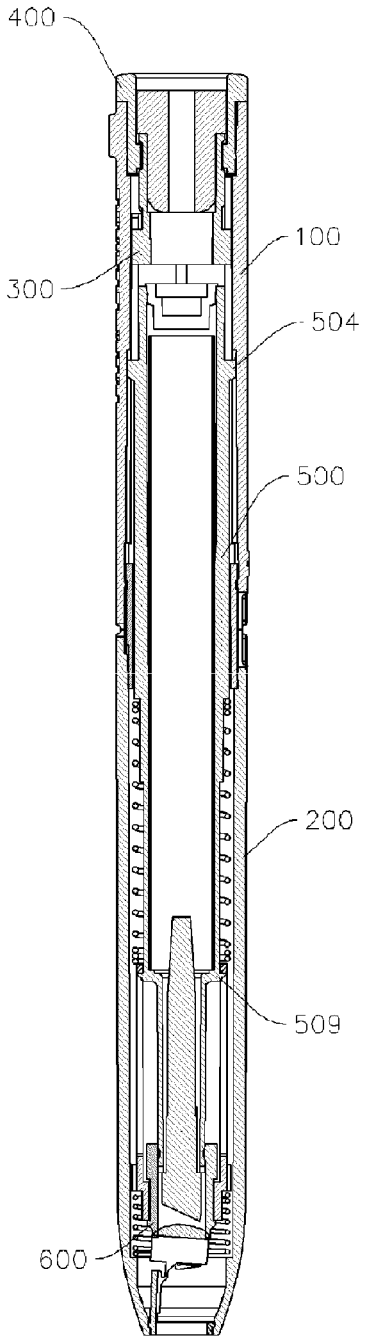
FIG. 9 shows the state of the rotary-type retractable writing implement with an anti-drying device being retracted.

FIG. 9 shows the assembled state of the rotary-type retractable writing implement with an anti-drying device (in the state of the nib being retracted and received in the holder in a sealed state).

As shown in FIG. 9, a portion of the nib cartridge 500 is received in the intermediate connection member 700, with the tooth 504 exposed to the outside of the slit 702.

Here, it is preferred that the intermediate connection member 700 have a guide groove extending from one side of the inside thereof to the slit 702 such that the tooth 504 is safely guided to the slit 702 when the nib cartridge 500 is inserted into one side of the intermediate connection member 700.

Here, the tooth 504 of the nib cartridge 500 is positioned in the direction of the other side of the slit 702 of the intermediate connection member 700.

In addition, the intermediate connection member 700 is received in the upper-shaft housing 100 such that the coupling protrusion 101 is engaged into the coupling groove 706, and the tooth 504 of the nib cartridge 500 confronts an inclined surface of the thread 102 of the upper-shaft housing.

Further, the other side of the nib cartridge 500 is received in the ball shutter 600, with the guide protrusion 509 positioned at the lower end of the slit 609 of the ball shutter 600 (this is because repulsive force is generated between the nib cartridge 500 and the ball shutter 600 by the restoring force of the first spring 71 positioned between the spring holding protrusion 503 of the nib cartridge 500 and the distal end of the holder 630.

In addition, since the holder 630 is pulled from the o-ring part 610 engaged against the fixing step 204 by means of the restoring force of the second spring 72 positioned between the lower-shaft housing 200 and the ball shutter 600, the ball type door 620 is rotated to close the inlet of the holder 630.

That is, since the o-ring 611 is fixedly positioned to the nib hole 205, the first and second hinges 613 and 635 are bent following the retraction of the holder 630, causing the ball type door 620 to rotate at 90°, thereby closing the upper end 132 of the holder 130.

Figure 10:
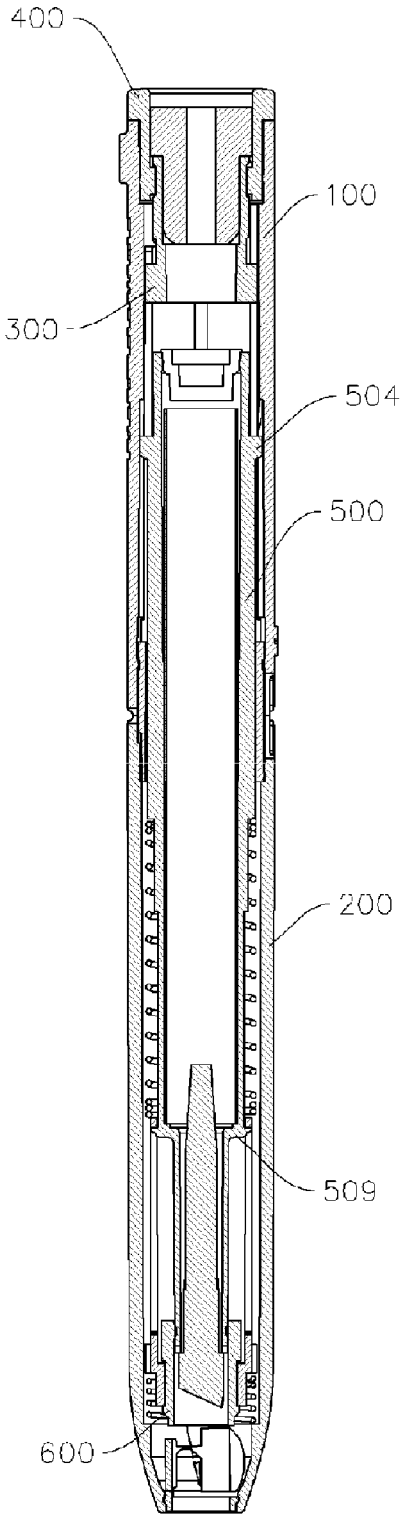
FIG. 10 shows the state of the rotary-type retractable writing implement with an anti-drying device as it advances.

In this state, as shown in FIG. 10, when the lower-shaft housing 200, which was fixedly coupled with the intermediate connection member 700, is rotated (in the direction of the inclined surface of the thread 102), the tooth 504 being exposed to the outside of the slit 702 of the intermediate connection member 700 linearly moves downwards along the slit while moving downwards along the inclined surface of the thread 102, thereby causing the nib cartridge 500 to move forwards in the direction of the nib hole 205.

With the forward movement of the nib cartridge 500, the first spring 71 and the ball shutter 600 move forwards together (here, the first spring 71 is almost never compressed). Then, the ball shutter 600 is subject to the restoring force of the compression of the second spring 72 positioned between the ball shutter 600 and the lower-shaft housing 200 to cause the ball type door 620 to open the holder 630, thereby providing the passage through which the nib 501 moves.

That is, the holder 630 moves forwards by a distance of a certain stroke, the first hinge 613 is hinged about the distal end of the connections of the ball type door 620, and the second hinge 635 bent is unfolded according to the amount of movement of the holder.

Further, the ball type door 620 is rotated at an angle that corresponds to the amount of forward movement of the holder 630.

With the forward movement of the holder 630, the first and second hinges 613 and 635 further rotate the ball type door 620. If the forward movement of the holder 630 and subsequent rotation of the ball type door 620 are continuously performed, a shown in FIG. 10, the passage through which the nib can protrude to the outside is provided.

Here, when the ball type door 620 rotates at 90° so that the spherical surface 621 confronts the inner wall of the housing, the second hinge 635 which was bent is returned to its original state, i.e. the unfolded flat state.

Thus, the through-passage of the ball type door 620 is open in the direction of an axis of the nib cartridge 500.

Along with this, inside the through-passage, the advanced holder 630 and nib 501 and the o-ring part 610 are positioned.

Here, since the tip or surrounding surface of the nib 501 of the nib cartridge 500 is still positioned inside the through-passage in a non-contact state, ink absorbed in the nib 501 cannot be smeared onto any part of the inner section of the ball type door 620, and the tip of the nib 501, which is positioned inside the nib hole 205, can be viewed by the naked eye.

In this state, when the lower-shaft housing 200 is further rotated, the tooth 504 of the nib cartridge 500 continuously moves downwards along the inclined surface of the thread 102 of the upper-shaft housing in a contact state while linearly moving downwards along the slit.

In addition, in the state of the ball shutter 600 being opened by means of compression of the second spring 72, when the tooth 504 of the nib cartridge 500 continuously moves downwards, the first spring 71 interposed between the spring holding protrusion 503 of the nib cartridge 500 and the distal end of the holder 630 of the ball shutter 600 becomes compressed, and the guide protrusion 509 of the nib cartridge 500 moves downwards (i.e. being advanced) along the slit 609 of the ball shutter 600.

Figure 11:
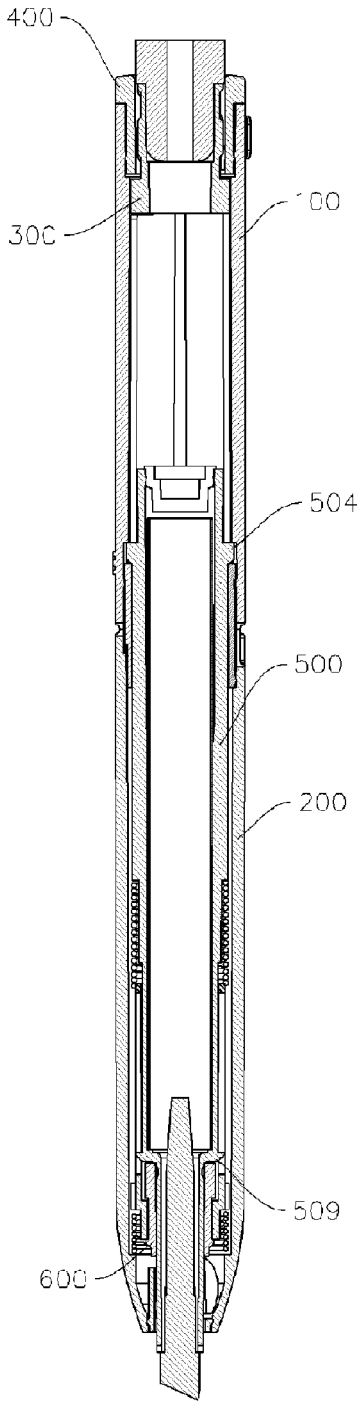
FIG. 11 shows the state of a nib of the rotary-type retractable writing implement with an anti-drying device advancing to the outside and being fixed.

When the lower-shaft housing 200 continues to be rotated as shown in FIG. 11, the anti-rotation protrusion 701 of the intermediate connection member 700 comes into contact with the stopper 103 of the upper-shaft housing 100. Here, when the lower-shaft housing 200 continues to rotate, the anti-rotation protrusion 701 climbs over the stopper 103 and then is engaged with the engaging step 104, thus being positioned between the stopper 103 and the engaging step 104, so that the intermediate connection member 700 can remain steadily therebetween such that it cannot move in the reverse direction of the rotating direction.

In the fixed state (in which the anti-rotation protrusion 701 is positioned between the stopper 103 and the step 104, being prevented from being rotated), the nib 501 is fixedly located in the state of protruding out of the nib hole 205.

In this fixed state, when the force is exerted to the lower-shaft housing 200 in the reverse rotation direction such that the anti-rotation protrusion 701 of the intermediate connection member 700 climbs over the stopper, the restoring force of the first spring 71 is generated to push out the nib cartridge 500, causing the nib cartridge 500 to be retracted.

With the retraction of the nib cartridge 500, the tooth 504 moves upwards and rotates along the thread 102 of the upper-shaft housing while linearly moving upwards along the slit 702 of the intermediate connection member 700.

As the nib cartridge 500 rotates, the intermediate connection member 700 also rotates, so that the nib cartridge 500 linearly moves upwards along the slit while rotatably moving upwards along the thread 102.

When the nib 501 is positioned inside the holder 630 of the ball shutter 600 as the nib cartridge 500 is retracted by means of the restoring force of the first spring 71, this results in the generation of the restoring force of the second spring 72, causing the ball shutter 600, the first spring 71, and the nib cartridge 500 to be retracted together.

As the distance between the o-ring part 601 of the ball shutter 600, which is fixed to the fixing step 204 of the lower-shaft housing 200, and the holder becomes greater because of the restoring force of the second spring 72, the first and second hinges 613 and 635 are bent to rotate the ball type door 620, closing the inlet of the holder 630.

Then, as the nib cartridge 500 is continuously retracted, the nib cartridge 500, in which the step of the cartridge connection was retracted to the lower end 131 of the holder 130, continuously rotates upwards until the tooth 504 comes into contact with the distal end of the thread 102 so that it cannot move forwards any more. Then, when the tooth 504 comes into contact with the distal end of the thread 102, the nib cartridge 500, the intermediate connection member 700, and the lower-shaft housing 200 stop rotating.

In this state, repulsive force is generated between the ball shutter 600 and the nib cartridge 500 by means of the first spring 71, causing the tooth 504 to come into contact with the distal end of the thread, being in the state shown in FIG. 9.

What is claimed is:

1. A rotary-type retractable writing implement with an anti-drying device comprising:

a nib cartridge having a writing nib;

an intermediate connection member having a slit along which the nib cartridge moves in the longitudinal direction in the intermediate connection member;

a lower-shaft housing fixedly coupled with the intermediate connection member and having a nib hole through which the nib is retractably advanced;

an upper-shaft housing having a thread along which the nib cartridge received in the intermediate connection member moves as the intermediate connection member and the lower-shaft housing are rotated together; and a ball shutter disposed in the lower-shaft housing and configured to open a passage for the nib when the nib is advanced in response to the longitudinal movement of the nib cartridge and to close the passage for the nib when the nib is retracted, such that the nib is received in the closed space, wherein as the intermediate connection member and the lower-shaft housing are rotated together, the nib cartridge moves downwards to cause the nib to protrude to the outside from the lower-shaft housing, wherein the lower-shaft housing comprises:

a groove provided in one side thereof at the position corresponding to the position of the coupling rim of the intermediate connection member and engaged with the coupling rim to create a secure coupling between the lower-shaft housing and the intermediate connection member;

a fixing step provided on an inner wall of the other side thereof such that an upper ring of the ball shutter is fixedly attached thereto; and a spring holding protrusion provided a certain distance away from the fixing step and against which a second spring is held by a step on an outer surface of the ball shutter so that opposite ends of the second spring are respectively engaged with the spring holding protrusion and the step of the ball shutter.

2. The rotary-type retractable writing implement with an anti-drying device according to claim 1, wherein the ball shutter comprises:

an o-ring part to be brought into close contact with the surface of the nib hole of the lower-shaft housing;

a ball type door having a spherical surface designed to block the nib such that the nib is sealed from the outside;

a holder having the form of a cylinder forming a through-passage for the nib;

a first hinge connecting the o-ring part and the ball type door; and a second hinge integrally connecting the ball type door and the holder, wherein as the holder moves away from the o-ring part being in a fixed state, the first and second hinges are bent to cause the ball type door to rotate, thereby providing the through-passage for the nib.

3. The rotary-type retractable writing implement with an anti-drying device according to claim 2, wherein the nib cartridge comprises:

an engaging step formed at a connection between a nib extension and an ink tank such that the nib passing through the inside of the ball shutter does not advance any further into the ball shutter;

a spring holding protrusion provided in the middle of an outer surface of the ink tank such that a first spring generates elastic force between the nib cartridge and one side of the ball shutter;

a tooth provided at a distal end of the ink tank such that the tooth linearly moves along the slit of the intermediate connection member, while concurrently moving along the thread of the upper-shaft housing; and a guide protrusion provided on the engaging step such that the guide protrusion linearly moves along the ball shutter within a slit range.

4. The rotary-type retractable writing implement with an anti-drying device according to claim 3, wherein the holder of the ball shutter has a slit for the nib cartridge in the direction of the nib cartridge such that the guide protrusion of the nib cartridge moves within the range of the slit for the nib cartridge.

5. The rotary-type retractable writing implement with an anti-drying device according to claim 1, wherein the intermediate connection member comprises:

a coupling rim for the lower-shaft housing having the form of a protruding ring in the end of one side of the intermediate connection member such that the coupling rim is engaged and fixedly coupled with an inner groove of the lower-shaft housing;

a first coupling groove having the form of a ring formed a certain distance away from the coupling rim such that the intermediate connection member and the upper-shaft housing are coupled such that they are rotated with respect to each other; and an anti-rotation protrusion provided a certain distance away from the first coupling groove, wherein a tooth of the nib cartridge received in the intermediate connection member is exposed to the outside of the slit, so that as the intermediate connection member and the lower-shaft housing are rotated, the tooth moves along the slit.

6. The rotary-type retractable writing implement with an anti-drying device according to claim 5, wherein the intermediate connection member further comprises:

a second coupling groove for the lower-shaft housing on the coupling rim such that the intermediate connection member and the lower-shaft housing are securely fixed, the second coupling groove being perpendicular to the coupling rim, wherein the second coupling groove is configured such that when coupled with the lower-shaft housing, the second coupling groove is engaged with a step of the lower-shaft housing provided at the position corresponding to the position of the second coupling groove.

7. The rotary-type retractable writing implement with an anti-drying device according to claim 5, wherein the upper-shaft housing comprises:

a coupling protrusion for the intermediate connection member provided on one side of an inner surface thereof such that the upper-shaft housing is rotatably coupled with the first coupling groove for the upper-shaft housing, provided in the intermediate connection member inserted into the upper-shaft housing;

a stopper provided a certain distance away from the coupling protrusion and having a thickness over which an anti-rotation protrusion of the intermediate connection member is able to climb;

a step provided on one side of the stopper and having a thickness over which the anti-rotation protrusion of the intermediate connection member is not able to climb; and a thread provided a certain distance away from the stopper or the step such that the thread forms a guide passage along which as the nib cartridge rotates together with the intermediate connection member, a tooth of the nib cartridge moves.

* * * * *